United States Patent [19]

Kuhn

[11] 4,040,422

[45] Aug. 9, 1977

[54] ANIMAL MEDICATION DISPENSER

[75] Inventor: Burt L. Kuhn, Phoenix, Ariz.

[73] Assignee: AKDOV Animal Health Care Products, Inc., Tempe, Ariz.

[21] Appl. No.: 667,575

[22] Filed: Mar. 17, 1976

[51] Int. Cl.[2] ..... A61D 7/00

[52] U.S. Cl. ..... 128/223; 128/235; 128/260

[58] Field of Search ..... 128/223, 222, 235, 234, 128/238, 261, 273, 218 P, 260

[56] References Cited

U.S. PATENT DOCUMENTS

| | | | |
|---|---|---|---|
| 688,168 | 12/1901 | Greenfield | 128/223 |
| 887,524 | 5/1908 | Roberts | 128/223 |
| 1,121,435 | 12/1914 | White | 128/223 |
| 1,609,640 | 12/1926 | Bell et al. | 128/234 |

FOREIGN PATENT DOCUMENTS

| | | | |
|---|---|---|---|
| 20,382 | 12/1917 | France | 128/223 |
| 476,139 | 7/1915 | France | 128/223 |
| 372,798 | 10/1921 | Germany | 128/223 |
| 16,926 | 7/1908 | United Kingdom | 128/223 |
| 2,155 | 12/1903 | United Kingdom | 128/223 |

*Primary Examiner*—Robert W. Michell
*Assistant Examiner*—Michael H. Thaler
*Attorney, Agent, or Firm*—Cahill, Sutton & Thomas

[57] ABSTRACT

A device for introducing food or medicine into an animal's mouth, the device being in the form of a bit having a longitudinally extending cavity, a connector for attaching a supply of medicine to the bit, the connector providing a passage for introducing the medicine to the cavity, and a plunger for moving the medicine through the cavity to a port, the port being positioned to convey the medicine from the bit cavity to the animal's mouth.

5 Claims, 4 Drawing Figures

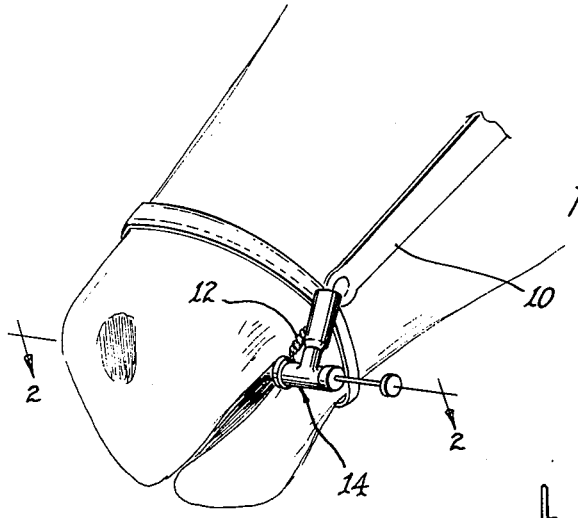
fig. 1
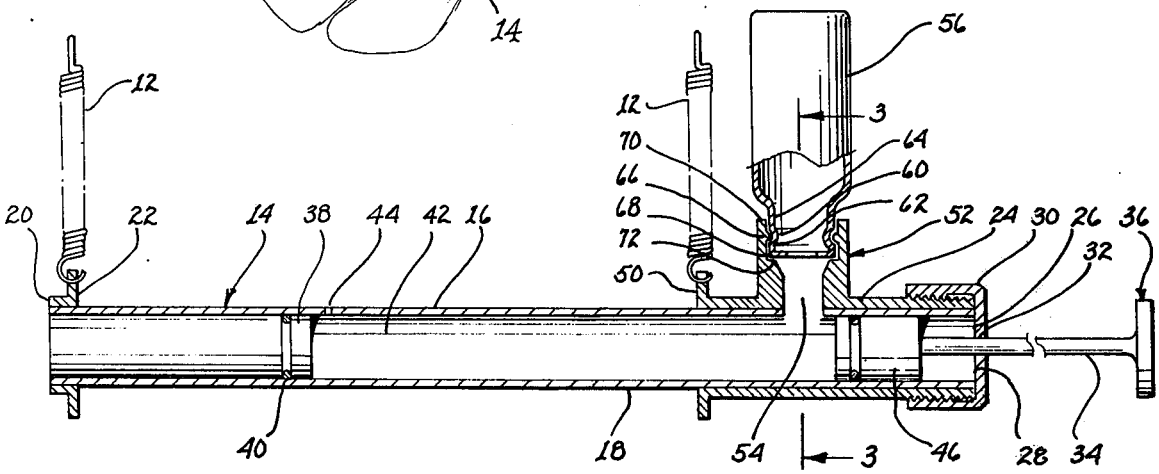
fig. 2
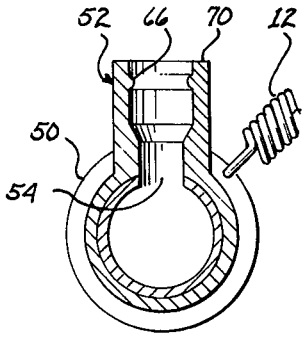
fig. 3
fig. 4
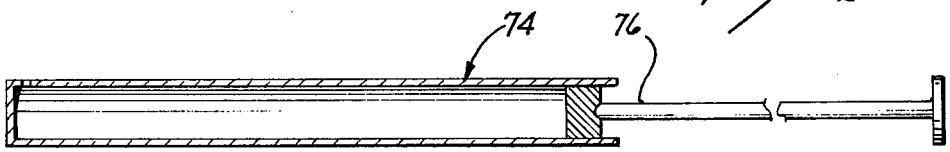

ANIMAL MEDICATION DISPENSER

This invention relates to a device for dispensing medication, food or the like and particularly to a device for dispensing medication orally which simulates a bit of the type normally worn by the animal being medicated.

Various devices have been designed over the years to enable medication to be taken orally by animals, particularly animals such as horses that are difficult to control. Generally, these devices are known as drenching bits. The bit is hollow with an inlet for the introduction of the liquid medicine and an outlet which communicates with the oral cavity when the bit is in position. The liquid medicine is conveyed through the bit to the exit port under pressure, from gravity, air, or the like. Modern animal medication is often packaged in standardized, disposable containers or ampules. It is desirable for health and convenience purposes to attach such container or ampule directly to the bit. This eliminates or at least measurably reduces the chances of contamination or improper dosage. Some animal medications are given in the form of heavy pastes contained in disposable cartridges equipped with a plunger for dispensing the paste. Again, it would be desirable to connect the cartridge directly to the bit such that the plunger could be utilized to deliver the paste medication through the bit and into the animal's mouth.

The present invention attains these desirable goals and provides further advantages as will be evident from the following discussion, such invention being a bit for delivery of a substance to the oral cavity of an animal comprising a tubular member adapted for positioning within an animal's mouth, said tubular member having an opening, and closure means spaced from said opening to define therebetween a cavity extending longitudinally interiorly into said tubular member, said opening of said tubular member being dimensioned to detachably receive plunger means having a working head dimensioned to slidably engage the walls of said cavity to move said substance through said cavity, connector means attached to said tubular member for connection thereto of a supply of said substance, said connector means having a passage communicating with said cavity for introduction of said substance into said cavity, aperture means in said tubular member, said aperture means being in communication within said cavity and providing an exit port for delivery of said substance from said cavity to the oral cavity of said animal.

Drawings are provided, wherein FIG. 1 is a perspective view showing the invention in use;

FIG. 2 is a cross-sectional view taken along line 2—2 of FIG. 2;

FIG. 3 is a cross-sectional view taken along line 3—3 of FIG 2; and

FIG. 4 is a cross-sectional view of a disposable cartridge which may be used with the invention as illustrated in FIGS. 1 - 3.

In FIG. 1, a horse is fitted with a conventional bridle 10 to which is attached by springs 12 the device of this invention in the form of a bit 14 held transversely in the horse's mouth.

The bit 14 is shown in detail in FIGS. 2 and 3. Bit 14 includes a housing 16 which may be constructed of metal or plastic or the like which can withstand the rigors of use and is inert to the medicines to be administered via the device. Housing 16 includes a tubular member 18 fitted at one end with an end cap 20 having a projection 22 to which is attached one of the springs 12.

To the other end of tubular member 18 is fitted a collar 24. Collar 24, which circumferentially surrounds tubular member 18, has an opening 26 coincident with endwise opening 28 of member 18. Collar 24 is externally threaded adjacent opening 26 to receive threaded cap 30 which covers openings 26 and 28 except for central aperture 32 which receives shaft 34 of plunger 36. Located at a distance slightly greater than one-half the distance from opening 28 to end cap 20 is a plug 38 fitted with an O-ring 40. Thus, a cavity 42 is provided between threaded cap 30 and plug 38. Within the confines of cavity 42 and in direct communication therewith is an aperture 44 located adjacent plug 38. Plunger head 46, connected to shaft 34, is located within cavity 42. Plunger head 46 is equipped with an O-ring to ensure a close, sliding, frictional engagement between the head and the walls defining cavity 42. Located between a second projection 50 to which a spring 12 is attached and threaded cap 30 is a connector 52. Connector 52, which is integral with collar 24, provides a passage 54 in direct communication with cavity 42. A vial or other container 56 providing a supply of medicine is attached to the bit by means of connector 52. Container 56 is elevated with respect to passage 54 and cavity 42 so that the medicine contained in container 56 will drain into cavity 42 due to gravity.

As is evident in the drawings, the straight hollow tubular member 18 has a cavity 42, a first end located in a first end portion (right side of FIG. 2), and a second end (left side of FIG. 2). Cavity 42 has a substantially uniform cross section. As shown, when tubular member 18 is positioned within the oral cavity of the animal, it has sufficient length for the first end portion to be located outside the oral cavity. In this specific embodiment, plug 38 constitutes end means for sealing off cavity 42. As shown, aperture 44 is at a position immediately adjacent the end means. Plunger head 46 has a working face (not numbered) and has substantially the same cross section as cavity 42.

Veterinary medicines may be stored in disposable containers having a standard neck design. In the embodiment illustrated in FIG. 2, the neck of container 56 has a circumferential groove 60 located between shoulders 62 and 64. Connector 52 is designed to receive the neck of container 56 in such a manner as to provide a positive, gripping attachment. Connector 52 has a circumferential extending ridge 66 located between shoulders 68 and 70. The neck of container 56 is made of a material which is sufficiently flexible that shoulder 62 can be made to pass over ridge 66 so that ridge 66 snaps into groove 60. Further inward movement of container 56 is prevented by the lip of container 56 striking shoulder 72. The fit of groove 60 in ridge 66 plus gravity prevents removal of container 56 during dispensing of the medicine. Container 56 can be removed by reversing the attachment procedure. Other means could be used for attaching container 56 to the connector. For example, the neck of container 56 and connector 52 may be complementarily threaded.

In use, the bit 14 is positioned in the animal's mouth. The container 56 may be attached to the bit prior to or after positioning the bit in the animal's mouth. If a prior connection is made, care must be taken so that medicine is not prematurely lost through aperture 44. After container 56 is attached and its contents delivered to cavity 42, plunger 36 is operated to push the medicine or other substance through cavity 42 and out aperture 44 into the animal's mouth.

In FIG. 4, a cartridge 74 is shown having a plunger 76. Cartridge 74 may contain a medicine or other substance having a consistency such as a heavy paste which would make drainage from the connector 52 into cavity 42 difficult. For medicines of this type, the threaded cap 30 of the device of FIGS. 1 - 3 may be removed along with the plunger 36. Cartridge 74 could then be inserted into cavity 42. The contents of cartridge 74 are then dispensed into cavity 42 and out aperture 44. The end of cartridge 74 could be removed by any conventional means to permit the substance to be dispensed. Also, cartridge 74 could be equipped with a port which would coincide with aperture 44 so that the medicine would move directly from the cartridge 74 through aperture 44. This would eliminate or reduce cleanup problems with the cavity 42. Cartridge 74 may be locked into place during use, if desired.

It is apparent that the device of this invention enables one to dispense medicine to animals in a safe, clean and efficacious manner using disposable medicine containers. The likelihood of dosage errors is thereby reduced. Loss of medicine is minimized as is the time required to introduce the medicine or other contents into the mouth. These advantages are in part due to the provision of the plug adjacent the aperture 44. The plug prevents medicine from flowing past the aperture 44 and coating the entire inner wall of the cavity with the resultant loss of medicine. Further, the plug allows the medicine being forced through cavity 42 to be directly diverted through aperture 44 under substantial pressure. It is to be understood that horses have been mentioned in connection with the description of the invention for illustrative purposes only and that the invention is not limited to horses but rather pertains to animals in general.

What is claimed is:

1. In combination, a drenching bit coupled to a bridle adapted to be attached to the head of an animal for positively and completely injecting a metered amount of a substance into the oral cavity of the animal at a controlled rate, said bit comprising:

a. a straight hollow tubular member having a tubular cavity having a substantially uniform cross section, a first end located in a first end portion, and a second end, said tubular member being positionable within the oral cavity of the animal and having sufficient length for the first end portion to be located outside said oral cavity;

b. a dispensing aperture disposed at a location in said tubular member intermediate the first and second ends;

c. end means for sealing off the tubular cavity of said tubular member at a position immediately adjacent said aperture;

d. passageway means located in said first end portion of said tubular member communicating with the tubular cavity for introducing the substance into the tubular cavity of said tubular member; and e. plunger means having a plunger head including a working face disposed within the tubular cavity, said plunger head having substantially the same cross section as said tubular cavity and being displaceable between a first position proximate to the first end of said tubular member and a second position proximate to said sealing end means for forcefully dispensing and completely evacuating the substance within the tubular cavity out through said dispensing aperture into the oral cavity of the animal as said plunger head is displaced from the first position to the second position;

f. said passageway means being intermediate said dispensing aperture and said working face when said plunger head is in said first position.

2. The bit according to claim 1 wherein said passageway means includes connector means attached to the tubular member for connection thereto of a supply of said substance.

3. The bit according to claim 2 in further including means for attaching said bit to said bridle.

4. The bit according to claim 3 wherein said plunger means includes a shaft connected to said plunger head and said tubular member includes a detachable end cap having a hole through which said shaft slidably passes, said end cap being located on said first end for permitting removal of said plunger head and cleaning of the tubular cavity.

5. The bit according to claim 4 wherein a container is sealingly attachable to and supported by said connector means.

* * * * *